United States Patent [19]

Ishii et al.

[11] Patent Number: 4,904,540

[45] Date of Patent: Feb. 27, 1990

[54] FE-CR-AL STAINLESS STEEL HAVING HIGH OXIDATION RESISTANCE AND SPALLING RESISTANCE AND FE-CR-AL STEEL FOR CATALYST SUBSTRATE OF CATALYTIC CONVERTER

[75] Inventors: Kazuhide Ishii; Tatsuo Kawasaki, both of Chiba, Japan

[73] Assignee: Kawasaki Steel Corp., Japan

[21] Appl. No.: 266,264

[22] Filed: Oct. 26, 1988

Related U.S. Application Data

[63] Continuation of Ser. No. 40,629, Apr. 20, 1987, abandoned.

[30] Foreign Application Priority Data

Apr. 21, 1986 [JP] Japan ..... 61-91815
Sep. 17, 1986 [JP] Japan ..... 61-218776

[51] Int. Cl.[4] ..... C22C 38/06; C22C 38/18; C22C 38/28

[52] U.S. Cl. ..... 428/606; 420/40

[58] Field of Search ..... 420/40; 428/606

[56] References Cited

U.S. PATENT DOCUMENTS

| | | | |
|---|---|---|---|
| 2,061,370 | 11/1936 | Rohn | 420/40 |
| 2,553,330 | 5/1951 | Post | 420/40 |
| 2,580,171 | 12/1951 | Mathasson et al. | 420/40 |
| 3,782,925 | 1/1974 | Brandis et al. | 420/40 |
| 3,852,063 | 12/1974 | Niimi et al. | 420/40 |
| 4,204,862 | 5/1980 | Kado et al. | 420/40 |
| 4,244,736 | 1/1981 | Day | 420/40 |
| 4,331,631 | 5/1982 | Chapman et al. | 420/40 |
| 4,376,245 | 3/1983 | Lindskog et al. | 420/40 |
| 4,385,934 | 5/1983 | McGurty | 420/40 |
| 4,414,023 | 11/1983 | Aggen et al. | 420/40 |
| 4,421,557 | 12/1983 | Rossomme et al. | 420/40 |

FOREIGN PATENT DOCUMENTS

| | | | |
|---|---|---|---|
| 035369 | 9/1981 | European Pat. Off. . | |
| 091526 | 10/1983 | European Pat. Off. . | |
| 1068023 | 10/1959 | Fed. Rep. of Germany . | |
| 1121099 | 1/1962 | Fed. Rep. of Germany | 420/40 |
| 2161954 | 6/1973 | Fed. Rep. of Germany | 420/40 |
| 2829373 | 1/1979 | Fed. Rep. of Germany | 420/40 |
| 30213 | 3/1977 | Japan | 420/40 |
| 865957 | 9/1981 | U.S.S.R. | 420/40 |
| 929734 | 5/1982 | U.S.S.R. | 420/40 |
| 833446 | 4/1960 | United Kingdom . | |

OTHER PUBLICATIONS

Noble Metal Catalysts on Metallic Substrates, Platinum Metals Review, vol. 21, No. 3, (1977) by A. S. Pratt & J. A. Cairns.

Metal Supports for Exhaust Gas Catalysts, SAE Technical Paper Series, Feb. 25–Mar. 1, 1985 by Manfred Nonnenmann.

*Primary Examiner*—John J. Zimmerman
*Attorney, Agent, or Firm*—Austin R. Miller

[57] ABSTRACT

A high oxidotion resistance Fe-Cr-Al alloy stainless steel foil suitable for forming catalytic converters, specifically for forming automotive catalytic converters. The alloy includes:

C: less than or equal to 0.02 Wt %;
Si: less than or equal to 1.0 Wt %;
Cr: in a range greater than or equal to 14 Wt % to less than or equal to 27 Wt %;
Al: in a range greater than or equal to 3.5 Wt % to less than or equal to 6.5 Wt %;
La: in a range greater than 0.05 Wt % and less than or equal to 0.20 Wt %;
Ce: less than or equal to 0.01 Wt % and the remainder being composed of Fe and inevitable impurities, the foil having a thickness less than or equal to 80 μm.

11 Claims, 3 Drawing Sheets

FE-CR-AL STAINLESS STEEL HAVING HIGH OXIDATION RESISTANCE AND SPALLING RESISTANCE AND FE-CR-AL STEEL FOR CATALYST SUBSTRATE OF CATALYTIC CONVERTER

This application is a continuation of application Serial No. 040,629, filed 4/20/87, abandoned.

BACKGROUND OF THE INVENTION

1. Field of the Invention

The present invention relates generally to a stainless steel having high oxidation resistance. More specifically, the invention relates to a Fe-Cr-Al alloy having satisfactorily high oxidation resistance and spalling resistance. Further particularly, the invention relates to a Fe-Cr-Al alloy suitable for a catalyst substrate of a catalytic converter.

2. Description of the Background Art

In recent years, atmospheric pollution due to existance of $NO_x$, CO and so forth has become a serious social problem. Such atmospheric pollution is led by exhaust gas from combustion facilities, such as internal combustion engines, boilers and so forth. Especially, pollution control has grown as one of the most important tasks to be achieved in the automotive vehicle technology. Therefore, it has become common to provide catalytic converters in exhaust systems of the automotive internal combustion engines.

As is well known, the catalytic converter generally comprises a catalyst substrate made of a ceramic and catalyst coated on the catalyst substrate surface. The catalyst is held on the catalyst substrate surface by means of a catalyst carrier. Conventionally, cordierite ($2M_gO0.2Al_2O_30.5SiO_2$) has been utilized as a material for forming the catalyst substrate. In the typical construction, the cordylite catalyst substrate is formed into honeycomb structure by extrusion and baking. Y-alumina fine particles are coated on the surface of the cordierite catalyst substrate to serve as the catalyst carrier. A catalyst made of platinium (Pt) and so forth is bonded on the catalyst carrier.

Another catalytic converter has been disclosed in the U.S. Pat. No. 4,331,631, issued on May 25, 1982, to Chapman et al. The disclosure suggests replacing the cordierite catalyst substrate with a metal substrate assembled by an oxidation resistant stainless steel foil into honeycomb structure. By replacing the cordierite catalyst substrate with the thin stainless steel foil catalyst substrate, the wall thickness of the honeycomb structure becomes thinner to expand the open air ratio of the honeycomb. As a result, the path area for the exhaust gas can be expanded. Since such catalyst substrate may provide a wider path area for the exhaust gas passing therethrough, the back pressure of exhaust gas can be reduced and good engine performance can be obtained. This, in turn, means that the size of the catalytic converter can be reduced to be compact enough by employing the stainless steel foil catalyst base.

As is well known, the catalyst carrier is held on the surface of an oxide layer formed on metal substrate. It is important that the alloy used as the substrate has good oxidation resistance and spalling resistance.

The disclosed invention employs Fe-Cr-Al alloy added an yttrium (Y). In the disclosure, the Fe-Cr-Al alloy is composed of chromium (Cr) of 15 to 25 Wt%, aluminum (Al) of 3 to 6 Wt% and Y of 0.3 to 1.0 Wt%.

Y is indeed a rare and expensive material. Furthermore, Y cannot be supplied at a sufficient amount for use in the automotive industry to manufacture the catalytic converters.

On the other hand, the U.S. Pat. No. 4,414,023, issued to Aggen et al. on Nov. 8, 1983, discloses a Fe-Cr-Al alloy composed of Cr of 8 to 25 Wt%, Al of 3 to 8 Wt%, and an addition of at least 0.02 Wt% and up to 0.05 Wt% from the group consisting of cerium (Ce), lanthanum (La), neodymium (Nd), praseodymium (Pr) with a total of all rare earth metals (REM) up to 0.06 Wt%. This alloy will be hereafter referred to as "Fe-Cr-Al-REM alloy ". In this Fe-Cr-Al-REM alloy, REMs improve the adherence of the oxide layer. Such alloy has been conventionally used for electric resistance heating elements.

The Fe-Cr-Al-REM alloy has reasonably high oxidation resistance when it is used in a form of a relatively thick plate. However, when it is used as the catalyst substrate, the thickness of the foil has to be thin enough to provide sufficient path area in view of the engine performance as set forth above. If the temperature of the exhaust gas rises when substantially high load is continuously applied to the engine as in high speed cruising, or a spark ignition timing is retarded excessively, rapid oxidation of the overall structure of the alloy occurs and the substrate becomes an oxide which is weak or brittle and tends to be easily broken. In addition, as is also well kown, pulsatile flow of the exhaust gas tends to be generated during engine driving to cause vibration simltaneously with high temperature oxidation. This tends to cause releasing of the oxide scale from the associated surface of the catalyst substrate. As set forth above, since the catalyst is bonded on the oxide scale by means of the catalyst carrier, the releasing of the oxide scale leads to removal of the catalyst to lower the exhaust gas purification performance of the catalytic converter.

It should be noted that, throughout the following disclosure, spalling resistance is used to represent the property of good adherence of the oxide scale on the surface of the catalyst substrate.

SUMMARY OF THE INVENTION

Therefore, it is an object of the invention to provide an Fe-Cr-al alloy which has substantially high oxidation resistance and can have good adherence of scale formed on its surface at any environmental condition.

Another object of the invention is to provide an Fe-Cr-Al alloy which is suitable to use for forming a catalyst substrate for a catalytic converter for an exhaust system in an automotive engine, a boiler combustion systems, and so forth.

A further object of the invention is to provide a substantially thin foil of Fe-Cr-Al stainless steel which has sufficient oxidation resistance and spalling resistance for use as material for forming a catalyst substrate.

In order to accomplish the aforementioned and other objects, a Fe-Cr-Al alloy, according to the present invention, comprises:

C: less than or equal to 0.02 Wt%;

Si: less than or equal to 1.0 Wt%;

Cr: in a range greater than or equal to 14 Wt% to less than or equal to 27 Wt%;

Al: in a range greater than or equal to 3.5 Wt% to less than or equal to 6.5 Wt%;

La: in a range greater than 0.05 Wt% and less than or equal to 0.20 Wt%;

Ce: less than or equal to 0.01 Wt%; and remaining materials composed of Fe and inevitable impurities.

It has been found that Ce accelerates oxidation at high temperature and La, Nd and so forth decelerate oxidation to expand the life of the Fe-Cr-Al stainless steel foil in the high temperature oxidation. Therefore, by reducing the content of Ce, shortening of the life of foil can be avoided. In addition, by providing La, Nd and so forth at sufficient content, the oxidation resistance of the Fe-Cr-Al alloy can be improved.

If necessary, titanium (Ti) can be added for the aforementioned Fe-Cr-Al alloy in a content range of 5-times or more of the content of C and less than or equal to 0.10 Wt%. In the alternative, the Fe-Cr-Al alloy set forth above comprises less than 0.02 WT% of La and lanthanide excluding Ce and La in a content greater than or equal to 0.001 Wt% and less than 0.03 Wt%, and total content of lanthanide including Ce and La is less than and equal to 0.20 Wt%. For the latter defined alloy, Ti can be added in a content range of the 5-times or more of content of C and less than or equal to 0.10 Wt%.

In order to be used as a material for a catalyst substrate, the aforementioned alloys may be formed into a thin foil having a thickness in a range greater than or equal to 20 μm and less than or equal to 80 μm.

As set forth, La has characteristics useful to expand the life of stainless steel foil in high temperature oxidation. The alloy is formed into a foil of thickness in a range of 20 μm to 80 μm, the life of the stainless steel foil is not sufficient for use as the catalyst substrate when the content of La is less than or equal to 0.05 Wt%. In other words, in order to provide sufficient oxidation resistance and spalling resistance, more than 0.05 Wt% of La has to be contained in the alloy to form the catalyst substrate. On the other hand, La has a tendency to degrade hot workability of the alloy. When the content of La exceeds 0.20 Wt%, it becomes impossible to hot roll the alloy. Lanthanides except for Ce have similar characteristics as set forth above with respect to La. Therefore, in case lanthanide other than Ce is present in the aforementioned Fe-Cr-Al alloy, the overall content should not exceed 0.20 Wt%.

In practice, a process for extracting La from the ore becomes easier and simpler if La is extracted with another lanthanide, such as Nd. For this reason, it would be practically beneficial to allow inclusion of lanthanide other than Ce and Le at a rate greater than or equal to 0.001 Wt% to less than 0.03 Wt%.

On the other hand, since Ce accelerates oxidation of the stainless steel foil and shortens its life, the content of Ce has to be minimized. Therefore, in order to form the proposed Fe-Cr-Al alloy, Mischmetal which contains 45% to 55% of Ce, 22% to 30% of La and 15% to 18% of Nd, cannot be used. Therefore, a metal which is prepared by removing Ce from Mischmetal should be used for making the aforementioned Fe-Cr-Al alloy.

When the content of Cr is less than 14 Wt%, enough oxidation resistance of the alloy cannot be obtained. Therefore, the content of Cr has to be greater than or equal to 14 Wt%. On the other hand, in case the alloy contains Cr in a content more than 27 Wt%, it decreases the toughness of the alloy and makes it impossible to cold roll the alloy. Therefore, the content of Cr should not exceed 27 Wt%. Similarly, when the content of Al is smaller than 3.5 Wt%, sufficient oxidation resistance cannot be obtained. Therefore, the content of Al should be greater than or equal to 3.5 Wt%. On the other hand, when the content of Al is greater than 6.5 Wt%, it is difficult to hot roll the alloy. Therefore, the content should be limited at the rate not greater than or equal to 6.5 Wt%

When Si is contained at a content greater than 1.0 Wt%, it decreases cold-workability. Therefore, the content of Si should not be more than 1.0 Wt%. When the alloy is formed into a plate with a relatively large thickness, Si will serve to enhance its oxidation resistance. However, when the alloy is formed into a substantially thin foil, such as that having a thickness of 20 μm to 80 μm, Si accelerates oxidation to shorten the life of the stainless steel foil in high temperature oxidation. From this point of view it is preferred to limit the content of Si to less than or equal to 0.4 Wt%.

C decreases toughness of the alloy and make cold rolling and other treatment of the alloy difficult. For this reason the content of C is limited to less than or equal to 0.02 Wt%.

As set forth above, Ti can be added for the Fe-Cr-Al alloy composed of the foregoing material. Ti is to be added for improving malleability of the alloy by fixing C. In order to obtain the desired effect, Ti has to be added at a content at least 5-times the amount of C. On the other hand, Ti tends to degrade the oxidation resistance of the alloy when it is added at a content in excess of 0.1 Wt%. Therefore, the amount of Ti is limited to a range of 5-times of the weight ratio of C but not greater than or equal to 0.10 Wt%.

As is well known, in the stainless steel production process, about 0.02 Wt% of P and about 0.005 Wt% of S are maintained. These serve as inevitable impurities to be contained in the alloy with Fe. However, presence of P and S will not affect the properties, characteristics or productivity of the inventive alloy. On the other hand, N as an inevitable impurity serves to decrease toughness similarly to C. Therefore, it is preferable to minimize the content of N. As long as the content of N is maintained less than or equal to 0.02 Wt%, the presence of N will never affect the property of the stainless steel foil.

When the catalyst substrate of honeycomb structure is formed by the Fe-Cr-Al alloy set forth above, it is preferable to minimize the thickness of the stainless steel foil from the viewpoint of performance of the exhaust system. Namely, by minimizing the thickness of the stainless steel foil, the path area of the honeycomb structure can be maximized to reduce resistance against the flow of the exhaust gas. As will be clear, decreasing of flow resistance for the exhaust gas improves engine performance and fuel economy. In view of the above, it is preferred to provide thickness of the stainless steel foil less than or equal to 80 μm. On the other hand, as will be appreciated, a thinner foil will have lower oxidation resistance and thus have shorter life. In this point, it is not practical to use a stainless steel foil having a thickness less than 20 μm. Therefore, the thickness of the stainless steel foil is practically limited to a range less than or equal to 80 μm and greater than or equal to 20 μm.

The Fe-Cr-Al alloy has a high oxidation resistance suitable for utilizing as catalyst substrate of a catalytic converter for an exhaust gas purification and/or high ability of holding catalyst on its surface. The Fe-Cr-Al alloy set forth above has sufficient malleability to form a substantially thin foil having a thickness in a range of 20 μm to 80 μm.

The present invention is further directed to a stainless steel foil for forming a calalytic converter, which is composed of a Fe-Cr-Al alloy at least composing Fe, C, Cr, Al, La and inevitable impurities, in which C, Cr, Al and La are present in the following contents:

C: less than or equal to 0.02 Wt%;

Cr: in a range of greater than or equal to 14 Wt% and less than or equal to 27 Wt%;

Al: in a range of greater than or equal to 3.5 Wt% and less than or equal to 6.5 Wt%;

La: in a range of greater than 0.05 Wt% and less than or equal to 0.20 Wt %.

The thin foil has high oxidation resistance ability suitable for utilizing as a catalyst substrate of a catalytic converter for exhaust gas purification and has a high ability of holding the catalyst on its surface. The foil forms a thin foil with a thickness in a range of 20 μm to 80 μm.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

The preferred embodiments, Fe-Cr-Al alloys are prepared at contents of the materials, i.e. C, Si, Cr, Al, Ti, REM as shown in the appended table 1. In order to compare the properties of Fe-Cr-al alloys constituting the preferred embodiment of the present invention, comparative examples are also prepared with the contents shown in the appended table 2. It should be noted that, in the comparative examples, mischmetal is added for examples B-2 and B-3. For the remainder, pure rare earth metal or metals are added. In the preparation of samples for testing, at first 10 kg ingots are cast by respective alloys, i.e. A-1 through A-9 and B-1 through B-14. After forming ingots, hot rolling is performed for respective samples to form plates 3 mm thick at 1200° C. of temperature. During this hot rolling process, the sample B-3 having the content of REM of 0.058 Wt%, the sample B-4 having the content of La of 0.22 Wt%, the sample B-6 having the content of Ce of 0.085 Wt% and the sample B-10 having the composite rate of Al of 8.2 Wt% were broken or cracked during the rolling process. Therefore, for these samples, i.e. B-3, B-4, B-6 and B-10, succeeding tests were not performed.

Figure 1:
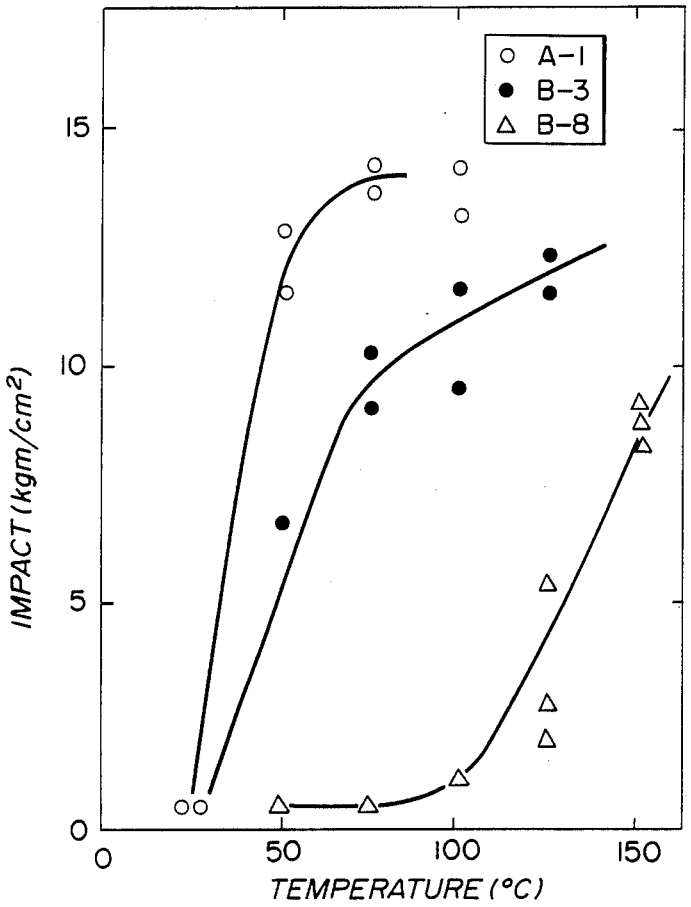
FIG. 1 is a graph showing the results of Charpy tests performed with respect to plates formed by hot rolling and annealing treatment.

The remaining samples were annealed at a temperature of 900° C. Then, Charpy tests were performed with respect to each sample for checking toughness. The results of the Charpy tests are shown in FIG. 1. In the observation of the result of testing, the samples A-1 having a carbon content of 0.001 Wt% and A-3 having a carbon content of 0.016 Wt% with an added 0.09 Wt% of Ti had a ductile/brittle transition temperature in a temperature range of 50° C. to 70° C. and thus were easily cold rolled. Contrary to this, the sample B-8 having a carbon content of 0.022 Wt% had transition temperature of 130° C. Therefore, it was difficult to cold roll the sample B-8 and it was thus processed by warm rolling. Similarly, the sample B-11 containing 27.2 Wt% of Cr and the sample B-14 containing 1.8 Wt% of Si had transition temperatures higher than 100° C. Therefore, it was impossible to cold roll the samples B-11 and B-14.

The samples thus formed into 3 mm thick plates were removed of scale. It should be noted that, since samples B-8, B-11 and B-14 were not possible to form into 3 mm thick plate, these samples were warm rolled at a temperature lower than 200° C. The samples formed into the 3 mm thick plates were subsequently annealed. By repeating the foregoing process, samples 50 μm thick and 0.5 mm thick were formed. From the foil thus formed, test pieces of 50 μm and 0.5 mm thick, 20 mm width and 30 mm length were prepared. Oxidation tests were performed with respect to each test foil in the atmosphere at 1150° C.

Figure 2:
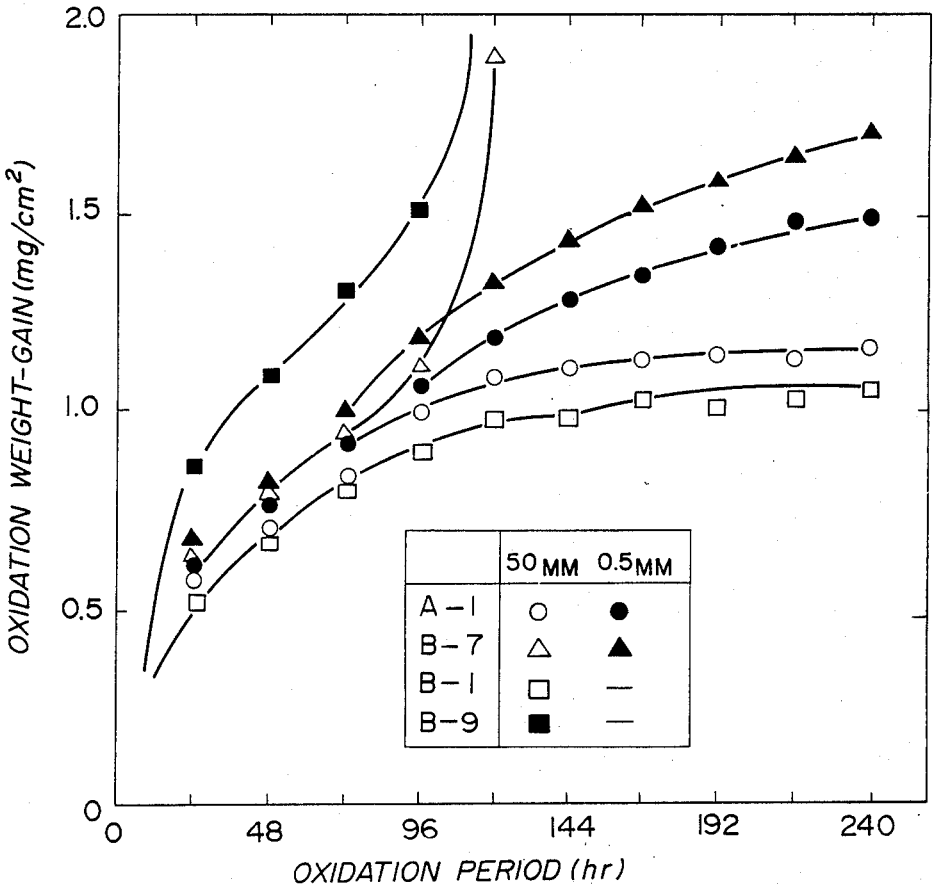
FIG. 2 is a graph showing the results of oxidation tests performed with respect to Fe-Cr-Al alloy.

The results of the oxidation test thus performed are illustrated in FIG. 2. As will be seen from Tables 1 and 2, the samples A-1 and B-7 have same contents of Cr (20 Wt%) and Al (5 Wt%). 0.08 Wt% of La was contained in the sample A-1 and 0.06 Wt% of Ce was contained in the sample B-7. When the oxidation test were performed with respect to 0.5 mm thick test pieces of the samples A-1 and B-7, there could not found any significant difference between these samples even after 240 hours. However, when the same oxidation test was performed with respect to the 50 μm thick test foils of the samples A-1 and B-7, the gain of weight due to oxide in the sample B-7 reached 1.0 mg/cm$^2$ after about 96 hours, and the quickly increasing rate became greater to reach at the value 8.0 mg/cm$^2$ after about 120 to 144 hours from the begining of the test. The gain of weight due to oxidation will be hereafter referred to as "oxidation weight-gain". At this condition, the test piece of the sample B-7 was completely oxidized and broke into small pieces. On the other hand, the oxidation weight-gain after 240 hours of the test piece of the sample A-1 was 1.1 mg/cm$^2$. It is evident that the sample A-1 had equivalent oxidation resistance to that of the sample B-1 which contains Y.

As is well known, Al in the Fe-Cr-Al alloy is oxidized during high temperature oxidation to form an $Al_2O_3$ layer on the surface. This layer serves as a protective layer so as not to oxidize Fe and Cr in the alloy. Therefore, with the presence of the $Al_2O_3$ layer, the Fe-Cr-Al alloy generally has high oxidation resistance. However, when the Fe-Cr-Al alloy is formed into a thin such as 50 μm thick foil, all the Al is oxidized when the oxidation period extends for a long period. After all of Al is oxidized, the foregoing general effect of the $Al_2O_3$ layer becomes not applicable in some alloys. Namely, whether the $Al_2O_3$ layer is effective or not is determined depending upon the REM contained in the alloy. For example, considering the 50 μm thick foil containing 5 Wt% of Al, the content of Al becomes approximately zero when the oxidation weight-gain reaches 1.0 mg/cm$^2$. On the other hand, it should be appreciated that when the same oxidation occurs on a plate 0.5 mm thick, the content of Al drops from 5 Wt% to 4.5 Wt%.

If the alloy contains Ce, oxidation resistance is then lost. Therefore, Fe and Cr in the alloy are quickly oxidized to be broken. On the other hand, if the alloy contains a sufficient concentration of La, Nd or Y, oxidation stops when overall Al is oxidized. Therefore, such alloy has a substantially long life in the high temperature oxidation. As will be clear herefrom, La and Nd may provide an equivalent effect in expanding life.

As will be seen from Table 2, though the comparative sample B-9 contains 0.21 Wt% of Ti, the sample B-12 contains 3.2 Wt% of Al and the sample B-13 contains 13.7 Wt% of Cr, the increases were insufficient.

Figure 3:
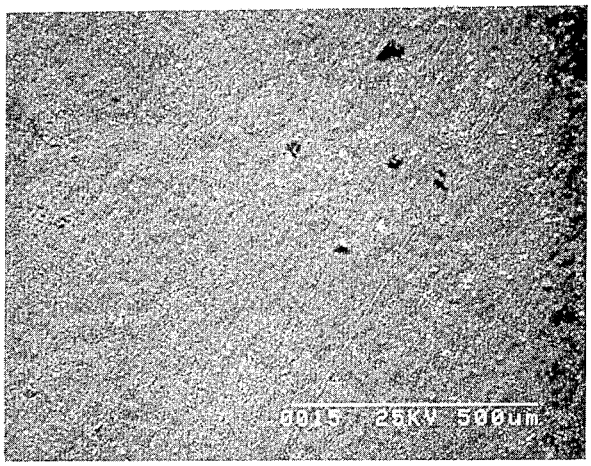
FIG. 3 is a scanning electron micrograph of the surface of the inventive Fe-Cr-Al alloy after cyclic oxidation.
Figure 4:
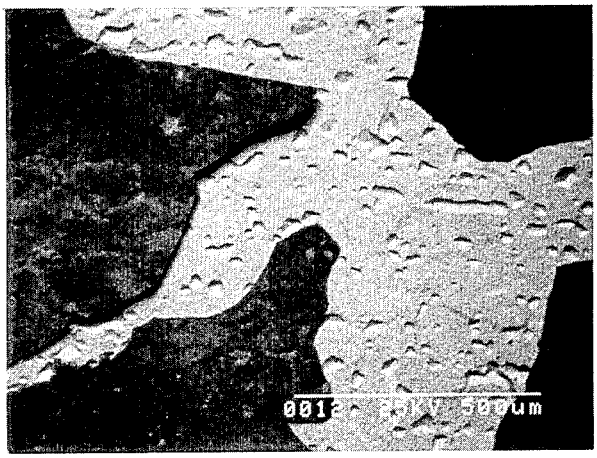
FIG. 4 is a scanning electron micrograph of the surface of a comparative example after cyclic oxidation.

Utilizing the same size of the test piece as used in the oxidation test, the oxide scale holding ability was tested. In the test, an oxidation cycle, in which oxidation for the test pieces is performed for 30 minutes in 1150° C. atmosphere and thereafter rapid cooling of the test piece for 12 minutes, was repeated for 200 cycles. After 200 cycles of the oxidation cycle, the surface conditions of respective test pieces was checked by means of a scanning electron microscope. FIG. 3 shows the surface condition of the test piece made of the sample A-2 after 200 oxidation cycles. Similarly, FIG. 4 shows the surface condition of the test piece of the comparative sample B-2. As will be seen from FIG. 3, the oxide scale of the test piece of the sample A-2 could be completely retained. On the other hand, as seen from FIG. 4 approximately half of the oxidation scale on the test piece of the sample B-2 was removed or released from the surface. A similar result was observed on the surface of the test piece of the sample B-5.

It should be appreciated that the judgement of the results of the foregoing tests are made according to the following standard.

HOT ROLLING ABILITY

○: hot rolling was possible after heating at 1200° C.;
●: hot rolling was not possible after heating at 1200° C.;

COLD ROLLING ABILITY

○: hot rolled and annealed sample has a ductile/brittle transistion temperature lower than 100° C.;
●: hot rolled and annealed sample has ductile/brittle transition temperature higher than or equal to 100° C.

OXIDATION RESISTANCE

●: gain of weight in the 50 μm thick foil after heating at 1150° C. for 168 hours, is greater than or equal to 1.5 mg/cm$^2$.

SPALLING RESISTANCE

○: after 200 oxidation cycles, in each cycle of which the 50 μm thick foil is heated AT 1150° C. atmosphere for 30 minutes and thereafter rapidly cooled for 12 minutes, no release of oxide scale is observed;
●; after 200 oxidation cycles, release of oxide scale is observed.

EMBODIMENT 2

Respectively 5 ton alloys C-1 and C-2 of the appended table 3 were melted by means of a vacuum melting furnace and cast. The resulting ingots were treated according to the usual process of ferrite stainless steel treating process, in which the block is treated through an ingot break down step, hot rolling step and cold rolling step to be formedinto 0.3 mm thick cold rolled coil. This cold rolled coil was passed through a Senzimir mill to obtain a foil coil of 1000 mm width and 50 μm thick. The cold rolled coil was also passed through a CBS mill to form a 30 μm thick foil. In the compositions shown in Table 3, both alloys C-1 and C-2 exhibited good hot workability.

In the foregoing U.S. Pat. No. 4,331,631, it has been suggested to perform heat treatment for the surface of the alloy to form an $Al_2O_3$ whisker. In the disclosed structure, the catalyst is coated on the alloy surface with a whisker. Same treatment was made on alloy composed according to the invention. After heat treatment according to the disclosure of the aforementioned U.S. Patent, good $Al_2O_3$ whiskers could formed.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

TABLE 1

| MATERIAL | C Wt % | Si Wt % | Cr Wt % | Al Wt % | Ti Wt % | REM Wt % | HOT ROLLING ABILITY | COLD ROLLING ABILITY | OXIDATION RESISTANCE | SPALLING RESISTANCE |
|---|---|---|---|---|---|---|---|---|---|---|
| A-1 | 0.001 | 0.2 | 19.5 | 5.1 | — | La 0.081 | ○ | ○ | ○ | ○ |
| A-2 | 0.005 | 0.4 | 20.1 | 5.0 | 0.04 | La 0.092 | ○ | ○ | ○ | ○ |
| A-3 | 0.016 | 0.2 | 20.3 | 4.9 | 0.09 | La 0.065 | ○ | ○ | ○ | ○ |
| A-4 | 0.005 | 0.1 | 14.8 | 6.0 | — | La 0.073 | ○ | ○ | ○ | ○ |
| A-5 | 0.004 | 0.4 | 19.7 | 4.9 | 0.05 | La 0.077<br>Nd 0.014 | ○ | ○ | ○ | ○ |
| A-6 | 0.003 | 0.1 | 25.0 | 4.8 | 0.03 | La 0.061 | ○ | ○ | ○ | ○ |
| A-7 | 0.006 | 0.4 | 19.7 | 6.5 | 0.06 | La 0.089 | ○ | ○ | ○ | ○ |
| A-8 | 0.004 | 0.1 | 26.2 | 3.9 | — | La 0.076 | ○ | ○ | ○ | ○ |
| A-9 | 0.005 | 0.4 | 20.1 | 5.2 | — | La 0.058<br>Nd 0.022 | ○ | ○ | ○ | ○ |

○: gain of weight in the 50 μm thick foil after heating at 1150° C. for 168 hours is less than 1.5 mg/cm$^2$;

TABLE 2

| MATERIAL | C Wt % | Si Wt % | Cr Wt % | Al Wt % | Ti Wt % | REM Wt % | HOT ROLLING ABILITY | COLD ROLLING ABILITY | OXIDATION RESISTANCE | SPALLING RESISTANCE |
|---|---|---|---|---|---|---|---|---|---|---|
| B-1 | 0.007 | 0.1 | 19.7 | 5.0 | — | Y 0.28 | ○ | ○ | ○ | ○ |
| B-2 | 0.008 | 0.2 | 20.5 | 4.9 | — | Ce 0.018<br>La 0.012 | ○ | ○ | ● | ● |

TABLE 2-continued

| MATERIAL | C Wt % | Si Wt % | Cr Wt % | Al Wt % | Ti Wt % | REM Wt % | HOT ROLLING ABILITY | COLD ROLLING ABILITY | OXIDATION RESISTANCE | SPALLING RESISTANCE |
|---|---|---|---|---|---|---|---|---|---|---|
| | | | | | | Nd 0.002 | | | | |
| B-3 | 0.005 | 0.1 | 20.3 | 4.9 | — | Ce 0.031 | • | — | — | — |
| | | | | | | La 0.020 | | | | |
| | | | | | | Nd 0.007 | | | | |
| B-4 | 0.007 | 0.2 | 20.2 | 5.0 | — | La 0.22 | • | — | — | — |
| B-5 | 0.005 | 0.4 | 20.5 | 5.1 | — | La 0.03 | ○ | ○ | ○ | • |
| B-6 | 0.002 | 0.2 | 20.0 | 5.2 | — | Ce 0.085 | • | — | — | — |
| B-7 | 0.004 | 0.1 | 19.8 | 4.9 | — | Ce 0.062 | ○ | ○ | • | ○ |
| B-8 | 0.022 | 0.2 | 20.4 | 5.2 | — | La 0.079 | ○ | • | ○ | ○ |
| B-9 | 0.018 | 0.4 | 19.8 | 4.7 | 0.21 | La 0.065 | ○ | ○ | • | ○ |
| B-10 | 0.004 | 0.3 | 20.4 | 8.2 | 0.05 | La 0.015 | • | — | — | — |
| B-11 | 0.006 | 0.1 | 27.2 | 4.8 | 0.09 | La 0.058 | ○ | • | ○ | ○ |
| B-12 | 0.004 | 0.1 | 20.6 | 3.2 | — | La 0.062 | ○ | ○ | • | ○ |
| B-13 | 0.007 | 0.2 | 13.7 | 5.9 | — | La 0.162 | ○ | ○ | • | ○ |
| B-14 | 0.005 | 1.8 | 15.0 | 5.3 | 0.06 | La 0.065 | ○ | • | • | ○ |

TABLE 3

| MATERIAL | C Wt % | Si Wt % | Mn Wt % | P Wt % | S Wt % | Al Wt % | Cr Wt % | Ti Wt % | La Wt % | Ce Wt % | N Wt % |
|---|---|---|---|---|---|---|---|---|---|---|---|
| C-1 | 0.008 | 0.09 | 0.13 | 0.004 | 0.003 | 5.6 | 19.7 | 0.04 | 0.06 | <0.001 | 0.005 |
| C-2 | 0.017 | 0.22 | 0.11 | 0.020 | 0.003 | 5.0 | 17.4 | — | 0.08 | <0.001 | 0.008 |

What is claimed is:

1. A high oxidation resistantive Fe-Cr-Al stainless steel foil comprising:
   C: less than or equal to 0.02 Wt%;
   Si: less than or equal to 1.0 Wt%;
   Cr: in a range of greater than or equal to 14 Wt% and less than or equal to 27 Wt%;
   Al: in a range of greater than or equal to 3.5 Wt% and less than or equal to 6.5 Wt%;
   La: in a range of greater than 0.05 Wt% and less than or equal to 0.20 Wt%;
   Ce: less than or equal to 0.01%; and
   Fe and inevitable impurities as a remainder, said foil having a thickness less than or equal to 80 μm.

2. A high oxidation resistantive Fe-Cr-Al stainless steel foil comprising:
   C: less than or equal to 0.02 Wt%;
   Si: less than or equal to 1.0 Wt%;
   Cr: in a range of greater than or equal to 14 Wt% and less than or equal to 27 Wt%;
   Al: in a range of greater than or equal to 3.5 Wt% and less than or equal to 6.5 Wt%;
   La: in a range of greater than 0.05 Wt% and less than or equal to 0.20 Wt%;
   Ce: less than or equal to 0.01 Wt%;
   Ti: in a content greater than or equal to 5-times the content of C and less than or equal to 0.10 Wt%; and
   Fe and inevitable impurities as a remainder, said foil having a thickness less than or equal to 80 μm.

3. An Fe-Cr-Al stainless steel foil as set forth in claim 2, wherein said thickness of said foil is greater than or equal to 20 μm.

4. A high oxidation resistantive Fe-Cr-Al stainless steel foil comprising:
   C: less than or equal to 0.02 Wt%;
   Si: less than or equal to 1.0 Wt%;
   Cr: in a range of greater than or equal to 14 Wt% and less than or equal to 27 Wt%;
   Al; in a range of greater than or equal to 3.5 Wt% and less than or equal to 6.5 Wt%;
   La: in a range of greater than 0.06 Wt% and less than or equal to 0.20 Wt%;
   Ce: in a content less than or equal to 0.01 Wt%;
   lanthanides other than La and Ce in a content greater than or equal to 0.001 Wt% and less than 0.03 Wt%, and an overall content of the lanthanides including La and Ce less than or equal to 0.20 Wt%; and
   Fe and inevitable impurities as a remainder, said foil having a thickness less than or equal to 80 μm.

5. An Fe-Cr-Al stainless steel foil as set forth in claim 4, which is further composed of Ti in a content greater than or equal to 5-times the content of C and less than or equal to 0.10 Wt%.

6. An Fe-Cr-Al stainless steel foil as set forth in claim 4, wherein said thickness of said foil is greater than or equal to 20 μm.

7. An Fe-Cr-Al stainless steel foil as set forth in claim 1, wherein said thickness of said foil is greater than or equal to 20 μm.

8. A high oxidation resistantive Fe-Cr-Al stainless steel foil comprising:
   C: less than or equal to 0.02 Wt%;
   Si: less than or equal to 1.0 Wt%;
   Cr: in a range of greater than or equal to 14 Wt% and less than or equal to 27 Wt%;
   Al: in a range of greater than or equal to 3.5 Wt% and less than or equal to 6.5 Wt%;
   La: in a range of greater than 0.06 Wt% and less than or equal to 0.20 Wt%;
   Ce: less than or equal to 0.01%; and
   Fe and inevitable impurities as a remainder, said foil having a thickness less than or equal to 80 μm.

9. An Fe-Cr-Al stainless steel foil as set forth in claim 8, wherein said thickness of said foil is greater than or equal to 20 μm.

10. A high oxidation resistantive Fe-Cr-Al stainless steel foil comprising:
   C: less than or equal to 0.02 Wt%;
   Si: less than or equal to 1.0 Wt%;
   Cr: in a range of greater than or equal to 14 Wt% and less than or equal to 27 Wt%;
   Al: in a range of greater than or equal to 3.5 Wt% and less than or equal to 6.5 Wt%;

La: in a range of greater than 0.06 Wt% and less than or equal to 0.20 Wt%;

Ti: in a content greater than or equal to 5-times of content of C and less than or equal to 0.10 Wt%; and Ce: in a content less than or equal to 0.01 Wt%;

lanthanides other than La and Ce in a content greater than or equal to 0.001 Wt% and less than 0.03 Wt%, and an overall content of the lanthanides including La and Ce less than or equal to 0.20 Wt%; and Fe and inevitable impurities as a remainder, said foil having a thickness less than or equal to 80 μm.

11. An Fe-Cr-Al stainless steel foil as set forth in claim 10, wherein said thickness of said foil is greater than or equal to 20 μm.

* * * * *